US006460606B2

(12) United States Patent
Cornelissen et al.

(10) Patent No.: US 6,460,606 B2
(45) **Date of Patent: *Oct. 8, 2002**

(54) CONTINUOUS CASTING MACHINE

(75) Inventors: Marcus Cornelis Maria Cornelissen, Castricum; Ferdinand Hendrik Frinking, Akersloot, both of (NL); JongKeun Kim; SangJoon Kim, both of Kyungbuk (KR)

(73) Assignee: Corus Staal BV, CA Ijmuiden (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/254,147

(22) PCT Filed: Sep. 18, 1997

(86) PCT No.: PCT/NL97/00525

§ 371 (c)(1),
(2), (4) Date: Jul. 12, 1999

(87) PCT Pub. No.: WO98/12008

PCT Pub. Date: Mar. 26, 1998

(65) Prior Publication Data

US 2001/0050159 A1 Dec. 13, 2001

(30) Foreign Application Priority Data

Sep. 19, 1996 (EP) ..... 96202615

(51) Int. Cl.[7] ..... B22D 11/04; B22D 27/02
(52) U.S. Cl. ..... 164/466; 164/502
(58) Field of Search ..... 164/502, 466

(56) References Cited

FOREIGN PATENT DOCUMENTS

| | | | | |
|---|---|---|---|---|
| EP | 0040383 | | 11/1981 | |
| EP | 0092126 | | 10/1983 | |
| EP | 0401504 | | 12/1990 | |
| EP | 0685282 | | 12/1995 | |
| JP | 62-130752 | * | 6/1987 | ..... 164/466 |
| JP | 1-289543 | * | 6/1988 | ..... 164/466 |
| JP | 63-154246 | * | 6/1988 | ..... 164/466 |
| JP | 3275256 | | 12/1991 | |
| JP | 3294053 | | 12/1991 | |
| JP | 484650 | | 3/1992 | |
| JP | 4284956 | | 10/1992 | |
| JP | 5023804 | | 2/1993 | |
| JP | 5-285614 | * | 11/1993 | ..... 164/466 |
| JP | 6182517 | | 7/1994 | |
| JP | 6285605 | | 10/1994 | |
| JP | 7-32099 | * | 2/1995 | |
| JP | 7266010 | | 10/1995 | |
| JP | 7290219 | | 11/1995 | |
| JP | 890176 | | 4/1996 | |
| JP | 8187557 | | 7/1996 | |
| WO | 9520443 | | 8/1995 | |
| WO | 9520445 | | 8/1995 | |

OTHER PUBLICATIONS

Copy of the Notice of Japanese Reasons for Rejection (with English translation).
Summary of Russian Office Action.
Grigorieu, Constructions and Design of the Steel Casting Machines, pp. 434–437 (Moscow 1995).

* cited by examiner

*Primary Examiner*—Kuang Y. Lin
(74) *Attorney, Agent, or Firm*—Stevens, Davis, Miller & Mosher, LLP

(57) ABSTRACT

Continuous casting machine for the continuous casting of molten steel into a cast product, comprising a mold in which the molten steel is poured through an exit port of a nozzle, forming a bath of molten metal, and in which at least part of the metal is solidified, whereby the continuous casting machine is provided with control means for controlling the flow of molten steel and operative on the molten steel after entering the mold such that the flow pattern of the molten steel in the mold is basically symmetrical with respect to at least one plane of symmetry of the mold.

13 Claims, 3 Drawing Sheets

CONTINUOUS CASTING MACHINE

TECHNICAL FIELD

The invention relates to a continuous casting machine for the continuous casting of molten metal in particular molten steel into a cast product, comprising a mould in which the molten metal is poured through an exit port of pouring means, forming a bath of molten metal, and in which at least part of the metal is solidified, to a mould suitable for such continuous casting machine and to a method for the operation thereof.

BACKGROUND ART

A continuous casting machine as referred to in this specification may be any of the known continuous casting machines such as a conventional casting machine for casting slabs having a thickness of about 250 mm or a thin slab casting machine for casting slabs having a thickness of about 150 mm or less e.g. in the range 50–100 mm.

Although not restricted to thin slab casting machines, in particular in such machines where the velocity at which the metal enters into the mould is high, the problem of unstable and/or unsymmetrical flow of the molten metal in the mould occurs. Most commonly, molten metal is poured from a tundish into the mould through a submerged entry nozzle as pouring means connected to the tundish and reaching into the mould. The center line of the nozzle generally corresponds with the center line of the mould.

A continuous casting machine of the referred type is well known in the art e.g. from WO 95/20445. A mould and a nozzle suitable for such a continuous casting machine are known from WO 95/20443. A further embodiment of a nozzle is known from EP 0 685 282.

In practice it has shown that the molten metal after entering the mould forms recirculations of unequal magnitude and shape. In the case of a single exit port of the nozzle two recirculations develop in the vertical plane on either side of the nozzle: a smaller one and a large one. The recirculations extend to the meniscus and cause a disturbance thereof, which disturbance is different for each of the two recircula-tions. The heat transfer by the circulating molten metal to the casting powder, floating on the surface of the molten bath, and therefore the temperature of the casting powder is different for the two recirculations. Consequently the effect of the casting powder on the heat transfer of the molten metal to the chilled walls of the mould is not uniform. The same applies to the lubricating effect of the casting powder between the walls of the mould and the metal. The recirculations may also lead to entrapment of casting powder and other inclusions into the bath of molten metal. The resulting effect, apart from surface and bulk defects, is that the cast thin slab is not uniform in temperature and because of the unpredictability of the position of each of the recirculations, the temperature distribution is not predictable ultimately resulting in a non-uniform thickness, or in other words shape-defects, of the cast slab.

In modern steel making plants wherein in a continuous or semi-continuous process steel is cast, hot-rolled and in some cases ferriticly rolled, there is no or only a very limited possibility of correction of the shape of the cast slab. Therefore shape control in this type of plant is a particular problem.

Although the problem of unstable and unsymmetrical flow in the mould has been elucidated with regard to thin slab casting, the problem also occurs in thick slab casting machines.

A direction in which in the prior art a solution was sought was the shape of the nozzle and of the exit ports thereof. Numerous proposals for the shape of the exit port, its angle relation to the longitudinal axis of the nozzle and the shape of the bottom of the nozzle were made. In thin slabs this necessitated a funnel shape of the mould.

Following this direction has not led to a satisfactory solution of the above-mentioned problems, in particular not to a solution suitable for the various casting conditions connected with various steel grades and sizes of the cast product.

SUMMARY OF THE INVENTION

An object of the invention is to provide a continuous casting machine with which these problems can be obviated or at least largely reduced and with which also other advantages can be obtained.

This object is reached with a continuous casting machine that is characterized in that, it is provided with control means for controlling and/or steering the flow of molten metal and operative on the molten metal after entering the mould such that the flow pattern of the molten metal in the mould is basically symmetrical with respect to at least one plane of symmetry of the mould.

BRIEF DESCRIPTION OF THE DRAWINGS

The invention will now be illustrated by a description of a prior art apparatus and embodiments of the invention which are not limiting and are described with references to the accompanying drawings, in which.

DETAILED DESCRIPTION OF THE PREFERRED EMBODIMENTS

Figure 1:
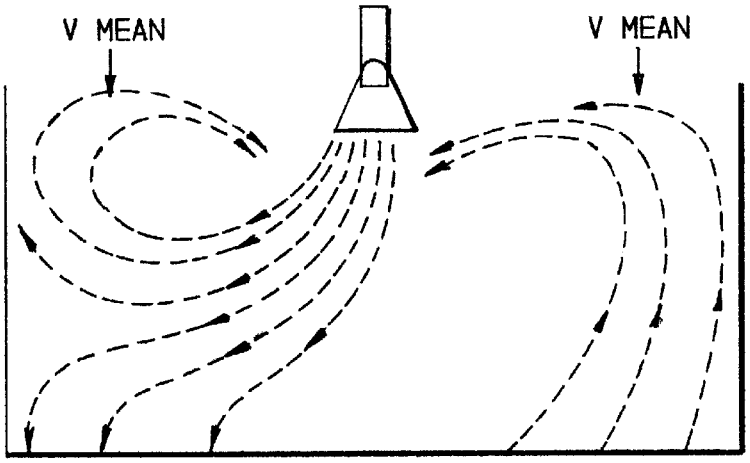
FIG. 1 shows diagrammatically the flow pattern in a model of the prior art apparatus.

The invention starts from the idea that the desired symmetry and stability are very difficult to achieve because the flow of molten metal and its behavior in the mould depends on many factors such as temperature and chemical composition of the molten metal, irregularities in the shape of the nozzle and changes therein during its lifetime because of wear and clogging, temperature gradients over the cooled walls of the mould, deviation in the shape of the mould. All these factors influence the flow in the mould and because each of these factors is difficult to predict or control, the flow is difficult to predict or control by selecting the shape of the nozzle.

According to the invention, control means are provided that cause a symmetrical flow or in other words, cause symmetrical and basically identical recirculations in the mould and eventually in the not solidified portion of the cast slab, by controlling and or steering the flow of the molten metal after it has entered the mould through the nozzle.

According to the invention, unsymmetrical or unstable behavior of the flow of molten metal is not primarily sought to be corrected by selecting the shape of the nozzle and its exit port or ports but by influencing the resulting flow of the metal in the mould and eventually in the non-solidified portion of the cast slab.

A simple contactless and reliable embodiment of the invention is characterized in that the control means comprise at least one magnetic brake apparatus preferably one electro magnetic brake apparatus.

Electro magnetic brakes for performing a stirring or braking action on a molten metal flow are well known in the art and have proven to be a reliable piece of equipment. In the known application as disclosed in e.g. EP 0 040 383 and EP 0 092 126 the electromagnetic brakes is used for stirring a bath of molten metal.

Electromagnetic stirrers are used for stirring the liquid metal between solidified dendritic solid crystals to remelt these crystals locally along the long axes and to form equiaxed shaped solidified crystals. The velocity of the liquid metal leaving the exit port of the entry nozzle is 10 to 100 times the casting speed. Electromagnetic brakes are used to brake this high velocity flow of liquid metal entering the mould to prevent deep penetration of the inflowing liquid metal, thereby preventing deep penetration of unwanted inclusions. Despite the beneficial effects of electromagnetic stirrers or brakes, the flow of liquid metal in the mould is not acceptable in view of instability and asymmetry. These unwanted phenomena are not prevented with the electromagnetic brakes and stirrers due to the practical operation.

Although static magnetic brakes are suitable it is preferred to use electromagnetic brakes because of the obtainable higher magnetic induction and the simplicity of controlling the magnetic induction by changing the current in the induction coils, in particular DC- or low frequency operated electromagnetic brakes.

According to the invention the control means, in this embodiment through the generation of an electromagnetic force field, effectively obstruct a periodic oscillation phenomena of liquid metal and an asymmetric flow in the mould, resulting in a very stable molten bath surface even in a condition of high casting speed of 2:0 m/min or more for conventional continuous casting machines and 4:0 m/min or more for thin slab casters, leading to a very sound and uniform solidified shell of solidified metal in the mould. When for some reason an asymmetry in the flow develops, there is an inequality in velocity of the flowing metal. Since the braking effect depends on the velocity the effect is to equalise the asymmetry by obstructing the higher velocity flow. Therefore the control means cause the recirculation to be basically equal and stable. The productivity of the continuous casting machine, in other words the economics, is dependent on the casting speed and can be substantially increased using the invention.

A very efficient embodiment of the invention is characterized in that the magnetic brake apparatus comprises two sets of magnetic braking poles spaced apart and operative in a braking way in a direction basically perpendicular to the direction of the flow of molten metal entering the mould through the exit port.

In this embodiment an essential portion of the main flow can flow, unobstructed, through the space between the two sets of poles. The outer portions of the flow pass through the magnetic brakes and are braked. Because unsymmetry in flow entails inequality in velocity and because the braking effect depends on the velocity of the molten metal passing the brake, the brake has an equalizing effect that prevents unsymmetry to occur and remedies occurring unsymmetries. Because of the simplicity of the construction this embodiment is easy to install and operate. Preferably each set of poles has a main distribution of the magnetic field perpendicular to the flow of molten metal entering the mould.

A simple and for general purpose application adequate embodiment of the invention is characterized in that the control means are positioned symmetrically with respect to the exit port of the pouring means.

The control means operate very efficiently in an embodiment of the invention that is characterized in that the control means extend in a direction basically perpendicular to the direction of a flow of molten metal entering the mould through the exit port.

In order to allow certain amount of recirculation and flow along the side-walls of the mould a further embodiment is characterized in that the control means are operative within a range between ⅛ and ⅞ of the width of the mould. This embodiment allows for sufficient flow of molten metal to the meniscus while stabilizing the remaining flow.

Surprisingly good effects can be obtained with an embodiment of the invention that is characterized by the control means comprising separating means for separating the flow of metal entering the mould in at least two subflows and for obstructing flow from one subflow to a second subflow in both parallel and funnel shaped mould.

The control means in principle divides the main flow of molten metal into two subflows in general of recirculation-shape, of equal magnitude. Unsymmetry means that one recirculation differs in magnitude from the other recirculation, unsymmetry therefore means that molten metal should pass the control means. Since such passage is obstructed by the control means, the recirculations and therefore the flow in the mould are basically equal and stable.

Preferably, the separating means comprise at least one set of magnetic poles, more preferably a set of electromagnetic poles. In a very effective embodiment the separating means is 1.5 to 10 times longer in the direction of casting than in the direction perpendicular thereto, i.e. the width of the mould.

Preferably the control means extend mainly perpendicular with respect to the flow of the molten metal. Preferably the control means are operative only over part of the longest side i.e. width of the mould, preferably between ⅛ and ⅞ thereof, each pole resulting in a main distribution of the magnetic field strength perpendicular to the flow of the molten metal entering the mould. Such control means as magnetic brake brakes and equalizes, due to the velocity dependency of the braking action, the main flow while giving a circulating flow the possibility to extend to the meniscus for the desired heat transfer. High velocity and disturbing recirculations occurring at the outer ends of the magnetic brakes pass through the brakes and are efficiently braked and reduced.

In general, as a consequence of the symmetrical flow in the mould, the velocity of occurring recirculations and the velocity at the meniscus of the mould both are relative low as compared with the situation known in the prior art.

To reduce the velocity at the meniscus still further, another embodiment of the continuous casting machine according to the invention is characterized in that the continuous casting machine is provided with braking means for lowering the velocity of the molten metal flowing at the meniscus of the bath of molten metal in the mould.

In certain applications a still smaller velocity at the meniscus is required, mainly to prevent disturbance of the meniscus and entrapment of particles of casting powder in the molten metal. With this embodiment the velocity at the meniscus can be reduced without essentially influencing the equalizing and stabilizing effect of the control means.

A very efficient, reliable and easy-to-operate braking means is characterized in that, the braking means comprise at least two magnetic brakes preferably two electro magnetic brakes positioned symmetrically with respect to at least one plane of symmetry of the mould and operative on the flow of metal directed to the meniscus of the molten metal. The recirculations occurring in the mould are directed upwardly near the short walls of the mould. Placing the braking means at this position, were the velocity is relatively high, a particular efficient braking effect is obtained with magnetic brakes.

Preferably the position of the control means is variable with respect to the mould. With this embodiment it is possible to place the control means in an optimum position in dependency of the mould and nozzle used. It is even possible to adapt the position to varying process conditions, while casting.

Preferably the position of the braking means is variable with respect to the mould. Also with this embodiment, an optimum position of the braking means in dependency of mould, nozzle and process conditions can be chosen and maintained even when process conditions vary.

The invention is also embodied in a mould provided with control means according to the invention and the further embodiments thereof and in a mould suitable for operation with such control means.

The invention is further embodied in a method for casting steel using a continuous casting machine according to the invention and embodiments thereof.

In a preferred embodiment the method is characterized in that the operation and/or position of the control means and/or brake means is selected in dependence of the temperature of the molten metal in the meniscus area.

A still further embodiment is characterized in that the operation and/or position of the control means and/or brake means is selected in dependence of the flow characteristics of the nozzle in the mould.

DESCRIPTION OF EXAMPLES AND DRAWINGS

The object and other advantages of the present invention will be illustrated by the following description of various embodiments and test results which are not-limitative and are described with reference to the accompanying drawings. In the tables $V_{mean}$ means the mean measured velocity at the meniscus.

In each of the figures identical numerals refer to identical items or items with corresponding functions. In each figure the dotted lines and the arrows therein indicate the direction of the flow of the molten metal.

The figures show the result of experiments conducted in a water model simulating the mould wherein water is used to simulate molten steel. It is known in the art that such modelling gives a very good representation of the actual behavior of molten steel is a mould. The water model has a rectangular cross-section of sizes 1500 mm width and 100 mm thickness in FIG. 1–6.

FIG. 1 shows the flow pattern as occurs in the prior art apparatus. The flow is highly unsymmetrical. The measured velocities are shown in the following table.

| A | $V_{mean}$ [cm/s] | |
|---|---|---|
| mm | left | right |
| | 30 | 7 |

Figure 2:
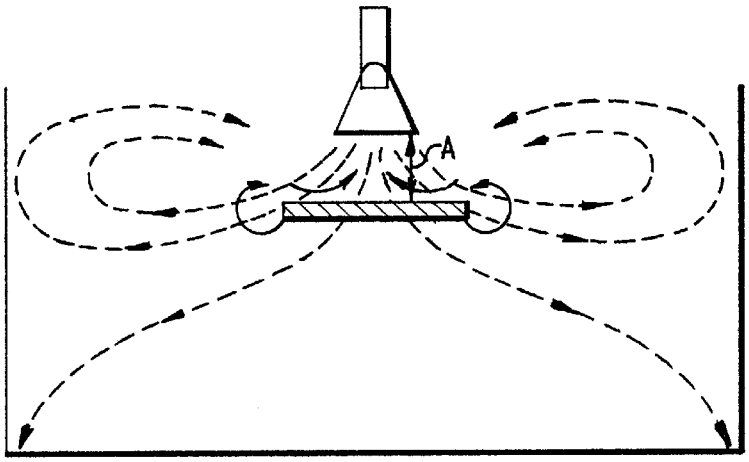
FIGS. 2–7 show diagrammatically the flow patterns obtained in a model of various embodiments of the present invention

FIG. 2 shows the flow pattern wherein control means are applied to the mould, the control means being for example a magnetic brake simulated by a mesh-type restriction. The letter A designates the distance between the exit port of the entry nozzle and the control means. Part of the water passes, braked, the control means, part is deflected upwardly and causes the desired heat flow to the surface of the bath. At the end of the control means, small recirculations occur which are effectively braked by the control means.

The results are summarized in the following table which shows that a substantial improvement in symmetry is obtained.

| A | $V_{mean}$ [cm/s] | |
|---|---|---|
| mm | left | right |
| 100 | 15 | 13 |
| 200 | 16 | 15 |
| 300 | 19 | 16 |
| 400 | 22 | 18 |

Figure 3:
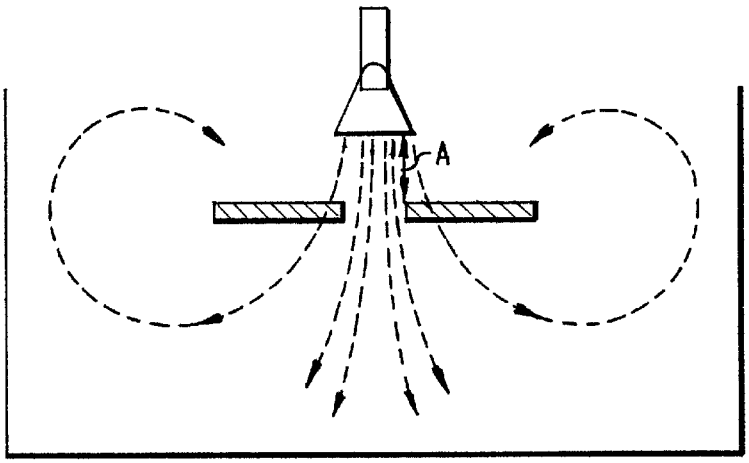

FIG. 3 shows the flow pattern obtained with another embodiment of the invention. The magnetic brakes comprises two sets of poles spaced apart in a direction basically perpendicular to the direction of the flow of molten metal. The center position of the flow passes the brake unobstructed. The side portion, which cause the recirculations are braked and equalized leading to a symmetrical and relative low velocity of the recirculations. The measured results are shown in the following table.

| A | $V_{mean}$ [cm/s] | |
|---|---|---|
| mm | left | right |
| 200 | 10 | 9 |

Figure 4:
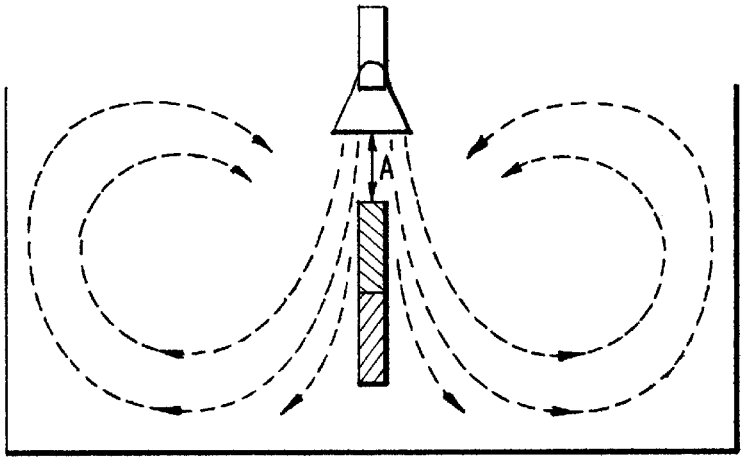

FIG. 4 shows a further embodiment wherein the control means comprise separating means embodied in a vertically placed magnetic brakes as simulated by a mesh-type control means, acting as an obstruction.

Surprisingly this embodiment has proven to be very effective. The operation is considered to be as follows: the control means splits the main flow in two subflows. Each subflow forming a recirculation. Once the main flow has been split in two symmetrically operating recirculations, instability and unsymmetry is prevented by the obstruction effect of the control means. The- splitting effect initiates the recirculations which prevent that the main flow enters deep into the bath and might thereby entail unwanted inclusions deep into the bath where they might be entrapped and included in the solidified metal such as steel. Entrapped inclusions may lead to serious defects in the final product.

It has been found that the operation of this embodiment is relative insensitive to the position of the control means relative to the entry nozzle in any direction. Also therefore this embodiment is very effective.

The obtained results are shown in the following table.

| A | $V_{mean}$ [cm/s] | |
|---|---|---|
| mm | left | right |
| 150 | 42 | 38 |
| 300 | 42 | 37 |

Figure 5:
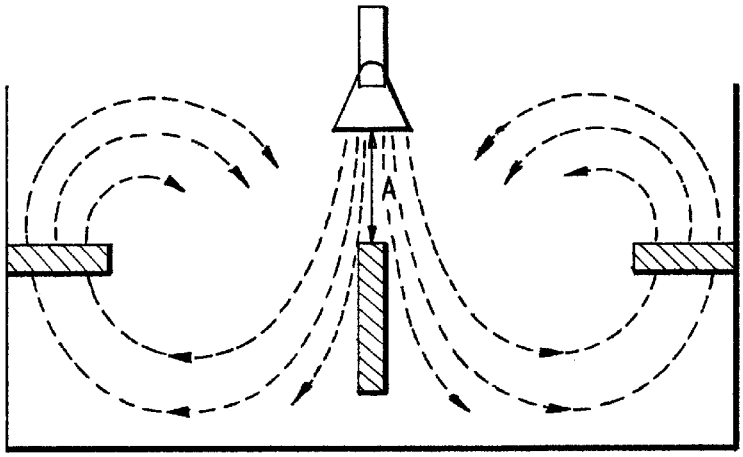

A further improvement can be obtained with an embodiment as shown in FIG. 5 which shows braking means for lowering the velocity of the flowing water at the meniscus of the bath. As can be seen from FIG. 4, the velocity at the surface is relative high. Such high velocity may cause a disturbance at the meniscus resulting in entrapment of melting powder particles such as in case of a steel bath. With the embodiment of FIG. 5 the velocity at the surface of the bath can be reduced to safe values without the risk of freezing of the meniscus. The measurement results are shown in the following table.

| A | $V_{mean}$ [cm/s] | |
|---|---|---|
| mm | left | right |
| 300 | 18 | 19 |

Figure 6:
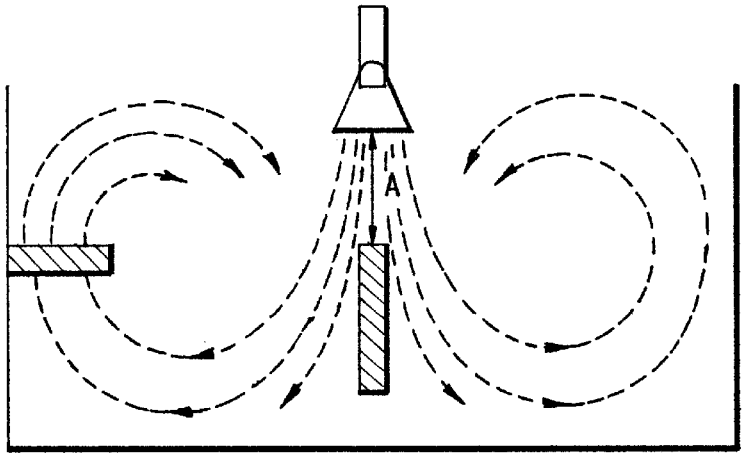

The surprising effect of the embodiment of FIG. 4 can be demonstrated by the results obtained with the embodiment of FIG. 6. In FIG. 6 only one brake of the embodiment of FIG. 5 is in operation, which leads to very different conditions between the left side and the right side of the mould. Despite this great disturbance, the two recirculations rotate symmetrically with respect to the plane of symmetry through the center line of the nozzle and the mould. The measured velocities at the surface of the bath are as follows:

| A | $V_{mean}$ [cm/s] | |
|---|---|---|
| mm | left | right |
| 300 | 16 | 36 |

Figure 7:
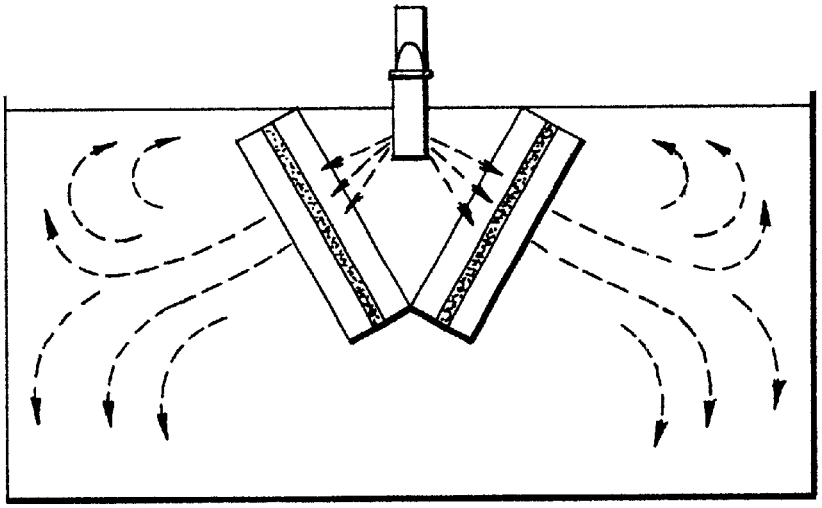

FIG. 7 shows another embodiment of the invention, in this case applied to a bifurcated nozzle and a funnel shaped mould. The casting speed was raised to 8 m/min. For each of the two mainflows exiting the nozzle a magnetic brake, simulated by a mesh-type control means is provided. By selecting the angle of the control means with respect to the direction of the main flow the relative magnitude of the upwardly directed flow and the downwardly directed flow components can be chosen. Further, control of the flow is possible by selecting the braking effect of the magnetic brake. This performance of this embodiment was measured by measuring the wave-height of the meniscus. Wave heights are equal for the left side and the right side and can be as low as 3 mm.

What is claimed is:

1. Continuous slab-casting machine for the continuous casting of molten metal into a cast slab-product, comprising:

a mould with long sides and short sides for receiving the molten metal poured through an exit port of a pouring means, forming a bath of molten metal, in which at least part of the metal is solidified and extracted from the mould in a casting direction;

at least one magnetic brake apparatus comprising, on each of the long sides of the mould a respective magnetic braking pole for operating in a braking way in a direction basically perpendicular to the direction of the flow of molten metal entering the mould through the exit port mainly in the casting direction, and the at least one magnetic brake apparatus extends in the direction of the flow of molten metal entering the mould, thus acting as a separating means for separating the flow of metal entering the mould in two subflows and for obstructing flow from one subflow to a second subflow, wherein the at least one magnetic brake apparatus is positioned for operating in a braking way on flow component of the molten inside the would which deviate from a flow pattern of the molten metal in the would which is basically symmetrical with respect to a plane of symmetry of the would transversely to its long sides, without substantially braking flow components of a symmetrical flow pattern, and each said magnetic brake apparatus consists of an electro magnetic brake apparatus, wherein the separating means comprises at least one set of electromagnetic poles, wherein the dimension of the separating means in the casting direction is a multiplying factor of 1.5 to 10 longer than that of transverse of the casting direction.

2. Continuous casting machine according to claim 1, wherein, the magnetic brake apparatus comprises two sets of magnetic braking poles spaced apart and which are positioned symmetrically with respect to the exit port of the pouring means.

3. Continuous casting machine according to claim 1, wherein the poles of the magnetic brake apparatus have a rectangular shape with a long side and a short side, and are positioned in such a way that, in operation, the long side is directed basically perpendicular to the direction of a flow of molten metal entering the mould through the exit port.

4. Continuous casting machine according to claim 1, wherein the magnetic brake apparatus is a means for operating within a range between ⅛ and ⅞ of the width of the mould.

5. Continuous casting machine according to claim 1 wherein, characterized in that, the continuous casting machine further is provided with braking means for lowering the velocity of the molten metal flowing at the meniscus of the bath of molten metal in the mould.

6. Continuous casting machine according to claim 1, wherein the braking means comprise at least two magnetic brakes positioned symmetrically with respect to at least plane of symmetry of the mould and operative on the flow of metal directed to the meniscus of the molten metal.

7. Continuous casting machine according to claim 5, wherein the braking means is movable such that the position of the braking means is variable with respect to the mould.

8. Continuous casting machine according to claim 1, wherein the magnetic brake apparatus is movable such that the position of the magnetic brake apparatus is variable with respect to the mould.

9. Continuous casting machine according to claim 6, wherein the braking means is movable such that the position of the braking means is variable with respect to the mould.

10. The continuous slab-casting machine of claim 1, wherein the machine is for the continuous casting of molten steel.

11. Method for casting metal using a continuous casting machine according to claim 1.

12. Method according to claim 11, wherein the magnetic brake apparatus is movable and the operation and/or position of the magnetic brake apparatus is selected in dependence of the temperature of the molten metal in the meniscus area.

13. The method of claim 11, wherein the metal is steel.

* * * * *

UNITED STATES PATENT AND TRADEMARK OFFICE

CERTIFICATE OF CORRECTION

PATENT NO. : 6,460,606 B2 
DATED : October 8, 2002
INVENTOR(S) : Marcus Cornelis Maria Cornelissen et al.

It is certified that error appears in the above-identified patent and that said Letters Patent is hereby corrected as shown below:

Title page,
Item [73], the names of the Assingees are -- Corus Staal B.V. and Research Institute of Industrial Science & Technology --.

Signed and Sealed this

Second Day of September, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,460,606 B2 
DATED : October 8, 2002
INVENTOR(S) : Marcus Cornelis Maria Cornelissen et al.

It is certified that error appears in the above-identified patent and that said Letters Patent is hereby corrected as shown below:

Title page,
Item [73], the names of the Assignees are -- Corus Staal B.V. and Research Institute of Industrial Science & Technology --.

This certificate supersedes Certificate of Correction issued September 2, 2003.

Signed and Sealed this

Twenty-fifth Day of November, 2003

JAMES E. ROGAN
*Director of the United States Patent and Trademark Office*